US010238913B1

(12) United States Patent
Tung

(10) Patent No.: US 10,238,913 B1
(45) Date of Patent: Mar. 26, 2019

(54) LIMITING STRUCTURE FOR A BODY-TRAINING DEVICE

(71) Applicant: SINGULARITY LTD., Belize (BZ)

(72) Inventor: Chia Lin Tung, Taichung (TW)

(73) Assignee: BH Asia Hong Kong Holding Co., Limited, Taichung (TW)

( * ) Notice: Subject to any disclaimer, the term of this patent is extended or adjusted under 35 U.S.C. 154(b) by 0 days.

(21) Appl. No.: 15/726,628

(22) Filed: Oct. 6, 2017

(30) Foreign Application Priority Data

Sep. 4, 2017 (TW) ..... 106130179 A

(51) Int. Cl.
*A63B 22/06* (2006.01)

(52) U.S. Cl.
CPC .. *A63B 22/0605* (2013.01); *A63B 2022/0641* (2013.01); *A63B 2022/0647* (2013.01)

(58) Field of Classification Search
CPC . A63B 22/00; A63B 22/0015; A63B 22/0023; A63B 22/06
See application file for complete search history.

(56) References Cited

U.S. PATENT DOCUMENTS 4,917,376 A * 4/1990 Lo ..... A63B 21/157 482/59
4,925,183 A * 5/1990 Kim ..... A63B 22/16 434/61
4,958,832 A * 9/1990 Kim ..... A63B 22/16 482/54
6,712,737 B1 * 3/2004 Nusbaum ..... A63B 69/16 482/57
7,166,067 B2 * 1/2007 Talish ..... A61H 1/001 482/148
7,682,286 B2 * 3/2010 Badarneh ..... A63B 26/003 482/4
7,833,129 B2 * 11/2010 Badarneh ..... A63B 22/0605 482/4
8,092,352 B2 * 1/2012 Irving ..... A63B 21/225 482/57
8,480,545 B2 * 7/2013 Irving ..... A63B 21/225 482/57
9,028,373 B2 * 5/2015 Irving ..... A63B 21/225 482/57
9,446,277 B2 * 9/2016 Irving ..... A63B 21/225
10,004,940 B2 * 6/2018 Badarneh ..... A63B 22/0023
2007/0072744 A1 * 3/2007 Badarneh ..... A63B 26/003 482/57
2008/0214971 A1 * 9/2008 Talish ..... A61H 1/005 601/23

(Continued)

*Primary Examiner* — Garrett K Atkinson
(74) *Attorney, Agent, or Firm* — Rosenberg, Klein & Lee

(57) ABSTRACT

A limiting structure for a body-training device includes a base, a positioning shaft, and a controlling member. The base comprises a slidable sleeve and the base is fixed on the foundation. The slidable sleeve has a shaft hole. The pivot holder of the body-training device has a positioning portion aiming at the shaft hole. The positioning shaft passes through the shaft hole. When a frame of the body-training device is standing, the positioning shaft can be slid to connect to the positioning portion so as to limit the pivot holder not to swing laterally. The controlling member is assembled on the frame and combined with the positioning shaft to control the positioning shaft to be slid to connect to the positioning portion or to be slid to detach from the positioning portion.

6 Claims, 9 Drawing Sheets

(56) References Cited

U.S. PATENT DOCUMENTS

| | | | | |
|---|---|---|---|---|
| 2009/0048076 | A1* | 2/2009 | Irving | A63B 21/015<br>482/57 |
| 2009/0170667 | A1* | 7/2009 | Irving | A63B 21/225<br>482/57 |
| 2010/0222183 | A1* | 9/2010 | Badarneh | A63B 26/003<br>482/57 |
| 2012/0071301 | A1* | 3/2012 | Kaylor | A63B 21/00058<br>482/57 |
| 2012/0108399 | A1* | 5/2012 | Irving | A63B 21/225<br>482/57 |
| 2013/0296139 | A1* | 11/2013 | Irving | A63B 21/225<br>482/57 |
| 2014/0378280 | A1* | 12/2014 | Kristiansen | A63B 22/0046<br>482/61 |
| 2015/0238797 | A1* | 8/2015 | Irving | A63B 21/225<br>482/57 |
| 2015/0290490 | A1* | 10/2015 | Badarneh | A63B 22/0023<br>482/6 |
| 2017/0001065 | A1* | 1/2017 | Irving | A63B 21/225 |

* cited by examiner

LIMITING STRUCTURE FOR A BODY-TRAINING DEVICE

BACKGROUND OF THE INVENTION

Field of the Invention

The present invention relates to a body-training device, in particular to a limiting structure for a body-training device.

Description of the Prior Art

A conventional laterally swingable spinning bike includes a foundation assembled with a frame. The frame is pivoted on the foundation through a pivot holder, and elastic members are on the foundation to support the pivot holder. When a user performs a lateral swing move to the frame, the frame is laterally swung by a certain angle and the elastic members support the frame to maintain the frame to be in that position.

Because of the elastic members assembled between the pivot holder and the foundation, the pivot holder assembled on the frame allows the user can swing the bike laterally to mimic road cycling. However, the conventional spinning bike is devoid a limiting structure to position the frame in the standing position when the user is riding the bike. Therefore, the conventional spinning bike fails to allow the user to ride the bike with both the standing position and the laterally-swingable position. Therefore, how to solve the problem is an issue.

SUMMARY OF THE INVENTION

One object of the present invention is to solve these problems and to provide a limiting structure for a body-training device. The limiting structure is assembled on the foundation of the frame, and the limiting structure comprises a base, a positioning shaft, and a controlling member. The controlling member drives the positioning shaft to slide in the slidable sleeves on the base, so that the positioning shaft is connected to or detached from the positioning portion of the pivot holder. Therefore, the pivot holder is controlled to be laterally swingable or to be standing straightly on the foundation. Accordingly, the user is allowed to ride the bike with both the standing position and the lateral-swingable position conveniently.

The body-training device is a frame laterally swingably pivoted on a foundation via a pivot holder, and a plurality of elastic members is on the foundation to support the pivot holder to keep the frame standing. When the frame is laterally swung, each of the elastic members is compressed and deformed to maintain the frame to be in a tilt position. In view of this, the limiting structure comprises:

- a base adapted to be fixed on the foundation and near the pivot holder, wherein a slidable sleeve is assembled on the base, the slidable sleeve has a shaft hole facing one side of the base, the pivot holder has a positioning portion aiming at the shaft hole;
- a positioning shaft passing through the shaft hole, wherein when the frame is standing, the positioning shaft is slidable to connect to the positioning portion so as to confine the pivot holder not to swing laterally; and
- a controlling member assembled on the frame and combined with the positioning shaft to control the positioning shaft to be slidable to connect to the positioning portion or to detach from the positioning portion.

In one embodiment, two slidable sleeves are assembled on the base, two positioning shafts are slidably assembled in shaft holes of the two slidable sleeves, and one ends of the two positioning shafts are connected to the controlling member, so that the control member drives the two positioning shafts to be slid in the shaft holes of the two slidable sleeves at the same time.

In one embodiment, the ends of the two positioning shafts are connected to the controlling member via a connection member. The controlling member is a steel cable and a tap switch. One of two ends of the steel cable is connected to the connection member and extending along the frame to a proper position, and the other end of the steel cable is connected to the tap switch. A resilient spring is assembled between the connection member and the base, and the resilient spring drives the two positioning shafts to connect to the positioning portion normally via the connection member, or the steel cable is pulled to control the two positioning shafts to slide at the same time and detach from the positioning portion via the tap switch.

In one embodiment, the ends of the two positioning shafts are connected to the controlling member via a connection member. The controlling member is a buckle, the buckle has a body, an operating portion connected to the body, and a connection bar connected to the operating portion. One end of the connection bar is connected to the connection member. A resilient spring is assembled between the connection member and the base, and the resilient spring drives the two positioning shafts to connect to the positioning portion normally via the connection member, or the operating portion is pulled up to control the two positioning shafts to slide at the same time and detach from the positioning portion via the connection bar.

In one embodiment, the positioning portion is a through hole on the pivot holder for passing through the positioning shaft.

In one embodiment, the elastic members are polyurethane adhesives.

DETAIL DESCRIPTION OF THE PREFERRED EMBODIMENTS

Please refer to FIGS. 1 to 9. The provided drawings are used to illustrate embodiments of the present invention and these embodiments are just for explanation of the invention, but not limitations of the invention.

Figure 1:
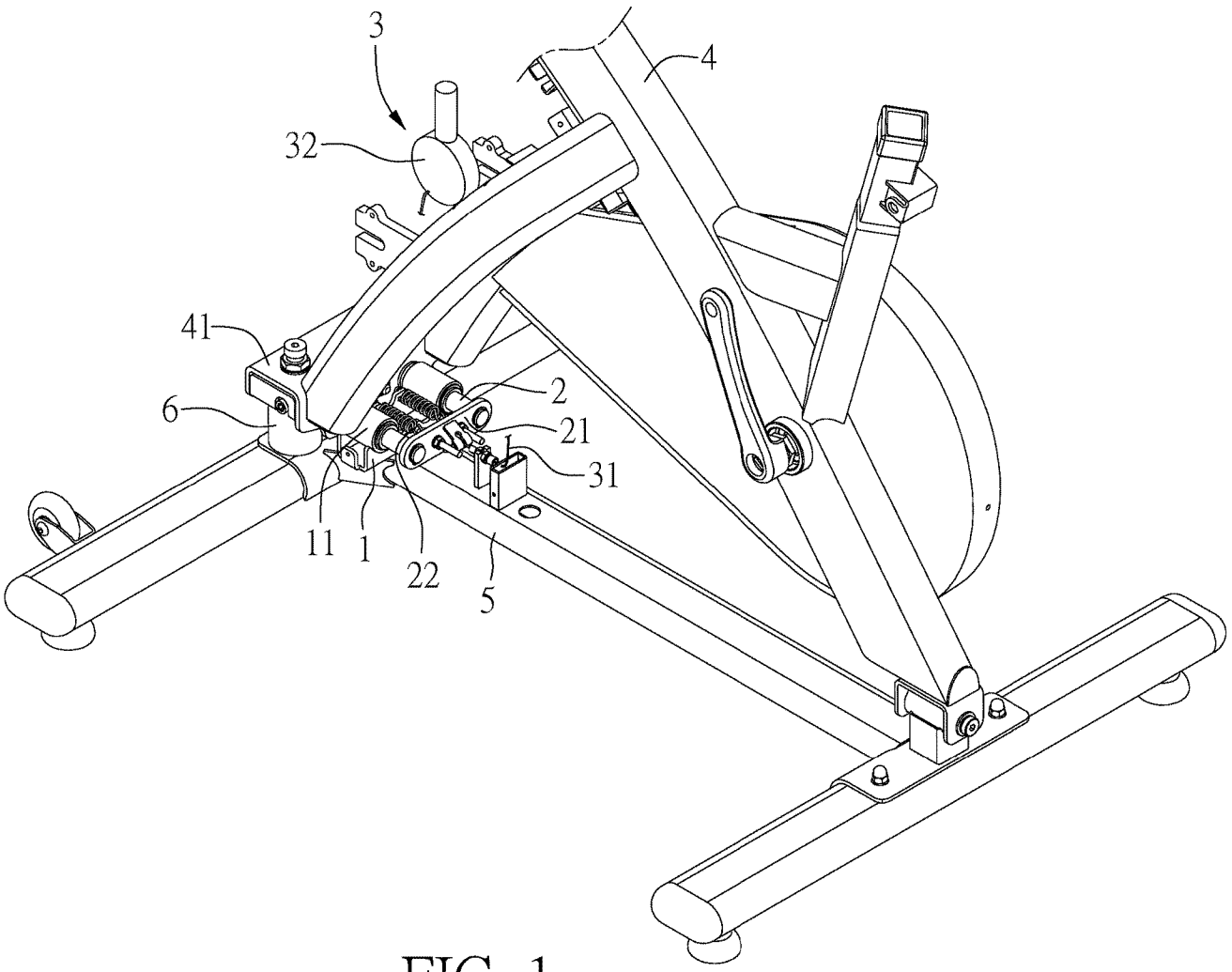
FIG. 1 illustrates a perspective view of a limiting structure for a body-training device according to a first embodiment of the present invention.
Figure 2:
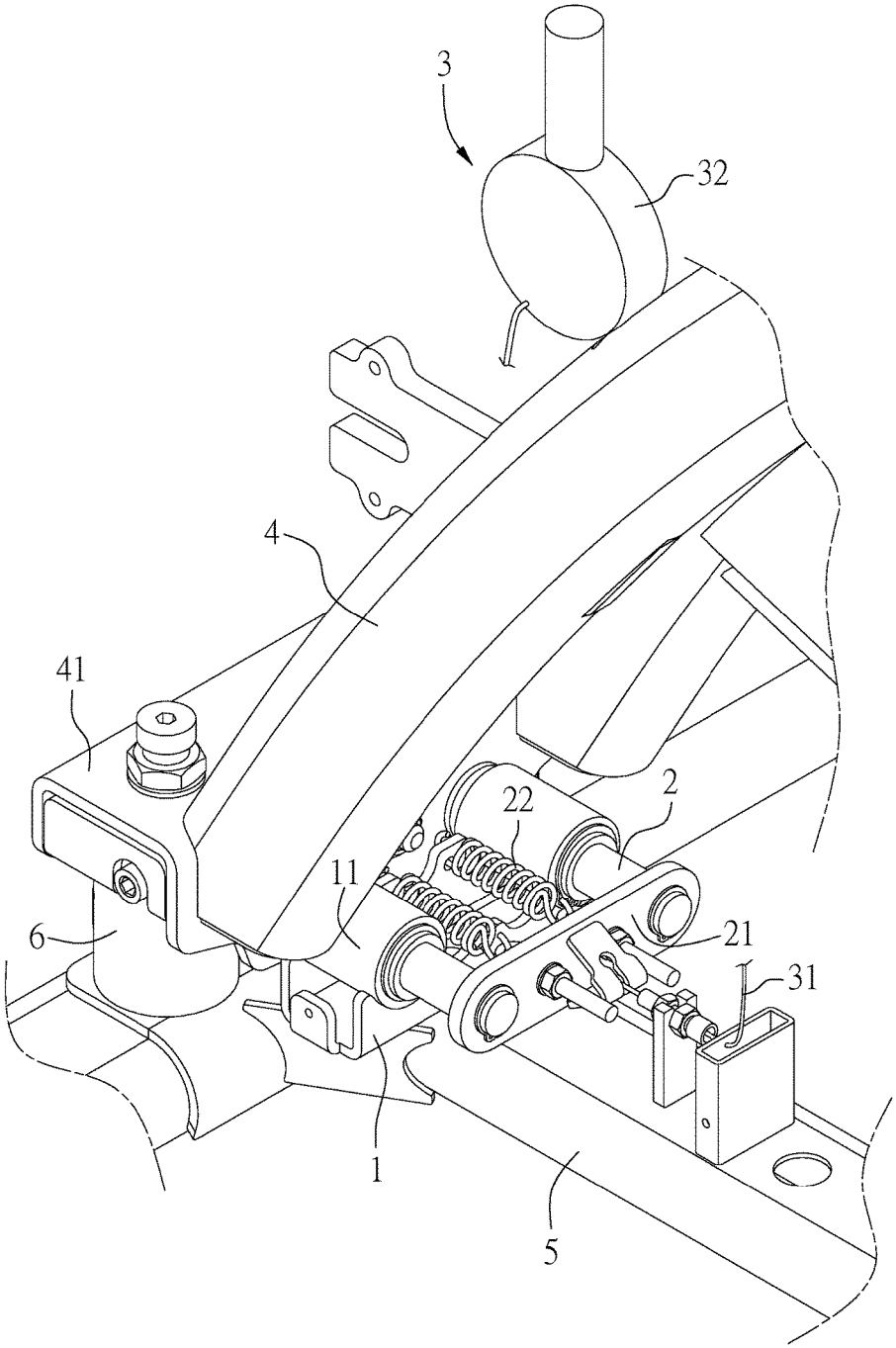
FIG. 2 illustrates a partial enlarged view of the limiting structure of the first embodiment.

The present invention provides a limiting structure for a body-training device. As shown in FIGS. 1 and 2, the limiting structure comprises a base 1, a positioning shaft 2, and a controlling member 3. The body-training device is a frame 4 laterally swingably pivoted on a foundation 5 via a pivot holder 41, and a plurality of elastic members 6 is on the foundation 5 to support the pivot holder 41 to keep the frame 4 standing. When the frame 4 is laterally swung, each of the elastic members 6 is compressed and deformed to maintain the frame 4 to be in a tilt position. The body-training device, in this embodiment, is a spinning bike, but embodiments are not limited thereto.

Figure 3:
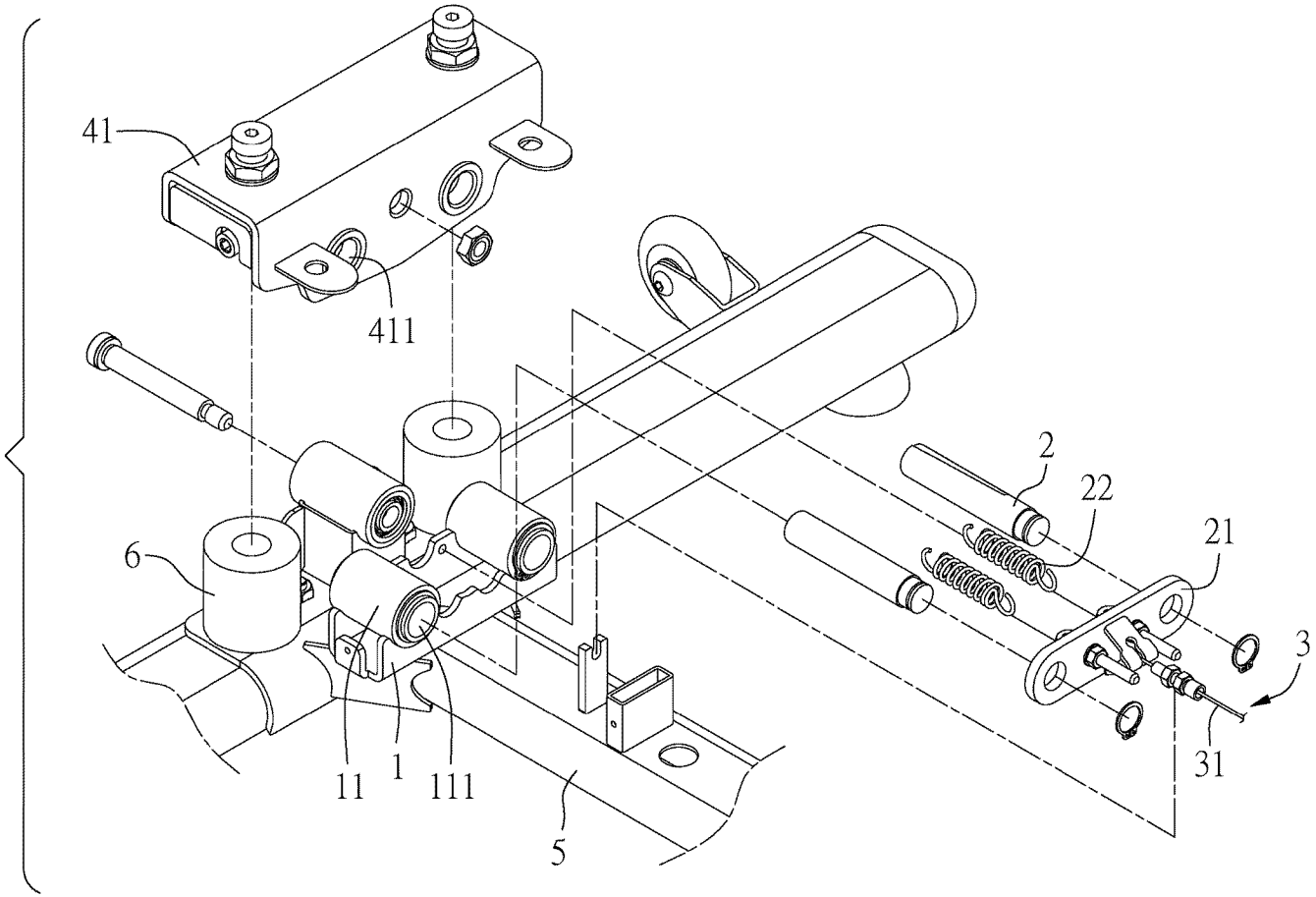
FIG. 3 illustrates an exploded view of the limiting structure of the first embodiment.
Figure 4:
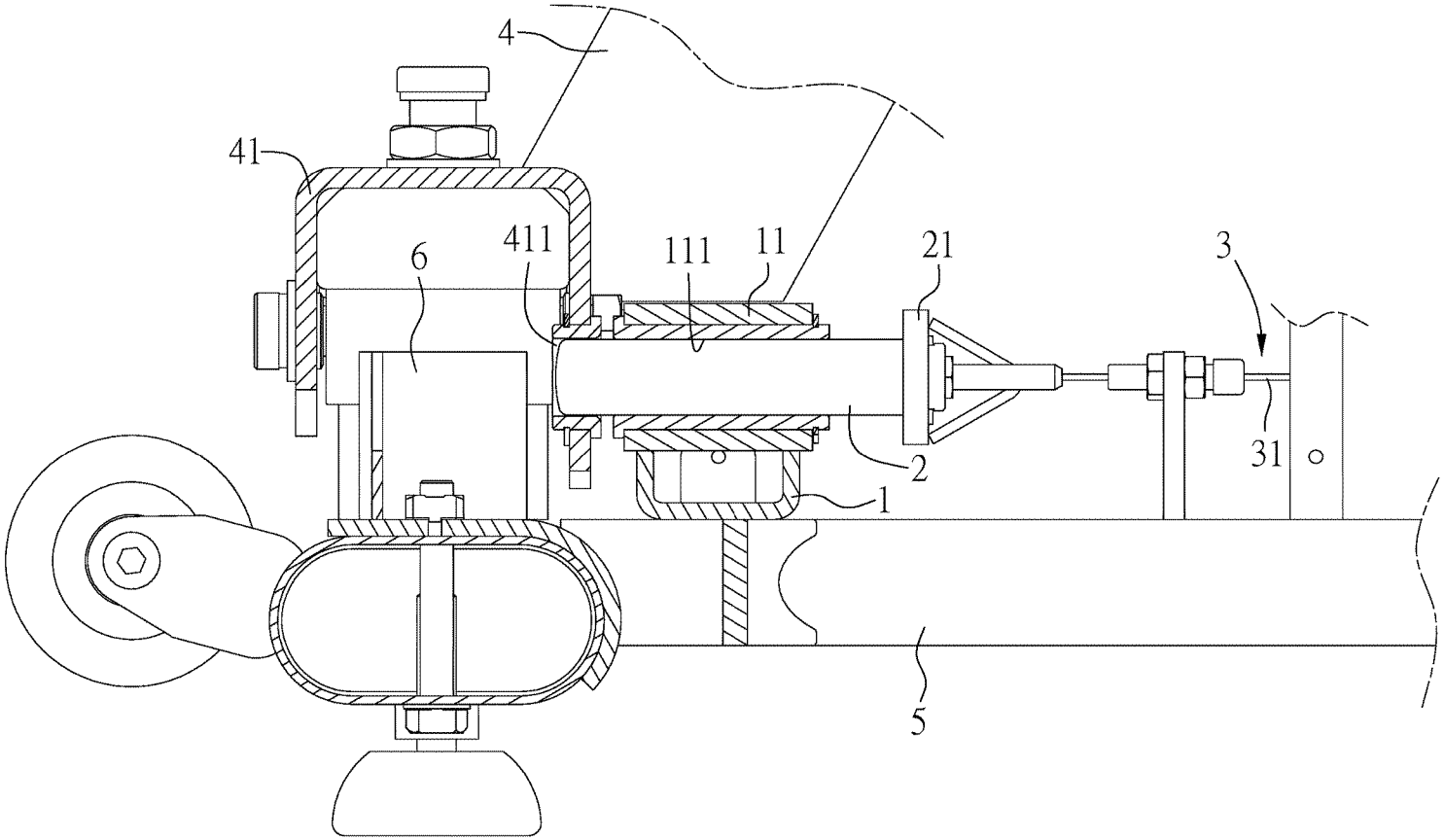
FIG. 4 illustrates a sectional view of the limiting structure of the first embodiment, and the positioning shaft is connected to the positioning portion in the figure.

As shown in FIGS. 3 and 4, the base 1 is adapted to be fixed on the foundation 5 and near the pivot holder 41. A slidable sleeve 11 is assembled on the base 1. The slidable sleeve 11 has a shaft hole 111 facing one side of the base 1. The pivot holder 41 has a positioning portion 411 aiming at the shaft hole 111. The positioning shaft 2 is passing through the shaft hole 111. When the frame 4 is standing, the positioning shaft 2 is slidable to connect to the positioning portion 411 so as to confine the pivot holder 41 not to swing laterally. The controlling member 3 is assembled on the frame 4 and combined with the positioning shaft 2 to control the positioning shaft 2 to be slidable to connect to the positioning portion 411 or to detach from the positioning portion 411.

As shown in FIGS. 3 and 4, in this embodiment, two slidable sleeves 11 are assembled on the base 1, and two positioning shafts 2 are slidably assembled in shaft holes 111 of the two slidable sleeves 11. One ends of the two positioning shafts 2 are connected to the controlling member 3, so that the controlling member 3 drives the two positioning shafts 2 to be slid in the shaft holes 111 of the two slidable sleeves 11 at the same time.

Furthermore, the ends of the two positioning shafts 2 are connected to the controlling member 3 via a connection member 21. In this embodiment, the controlling member 3 is a steel cable 31 and a tap switch 32. One of two ends of the steel cable 31 is connected to the connection member 21 and extending along the frame 4 to a proper position. The other end of the steel cable 31 is connected to the tap switch 32. A resilient spring 22 is assembled between the connection member 21 and the base 1. The resilient spring 22 drives the two positioning shafts 2 to connect to the positioning portion 411 normally via the connection member 21, or the tap switch 32 pulls the steel cable 31 to control the two positioning shafts 2 to slide at the same time and detach from the positioning portion 411.

Figure 5:
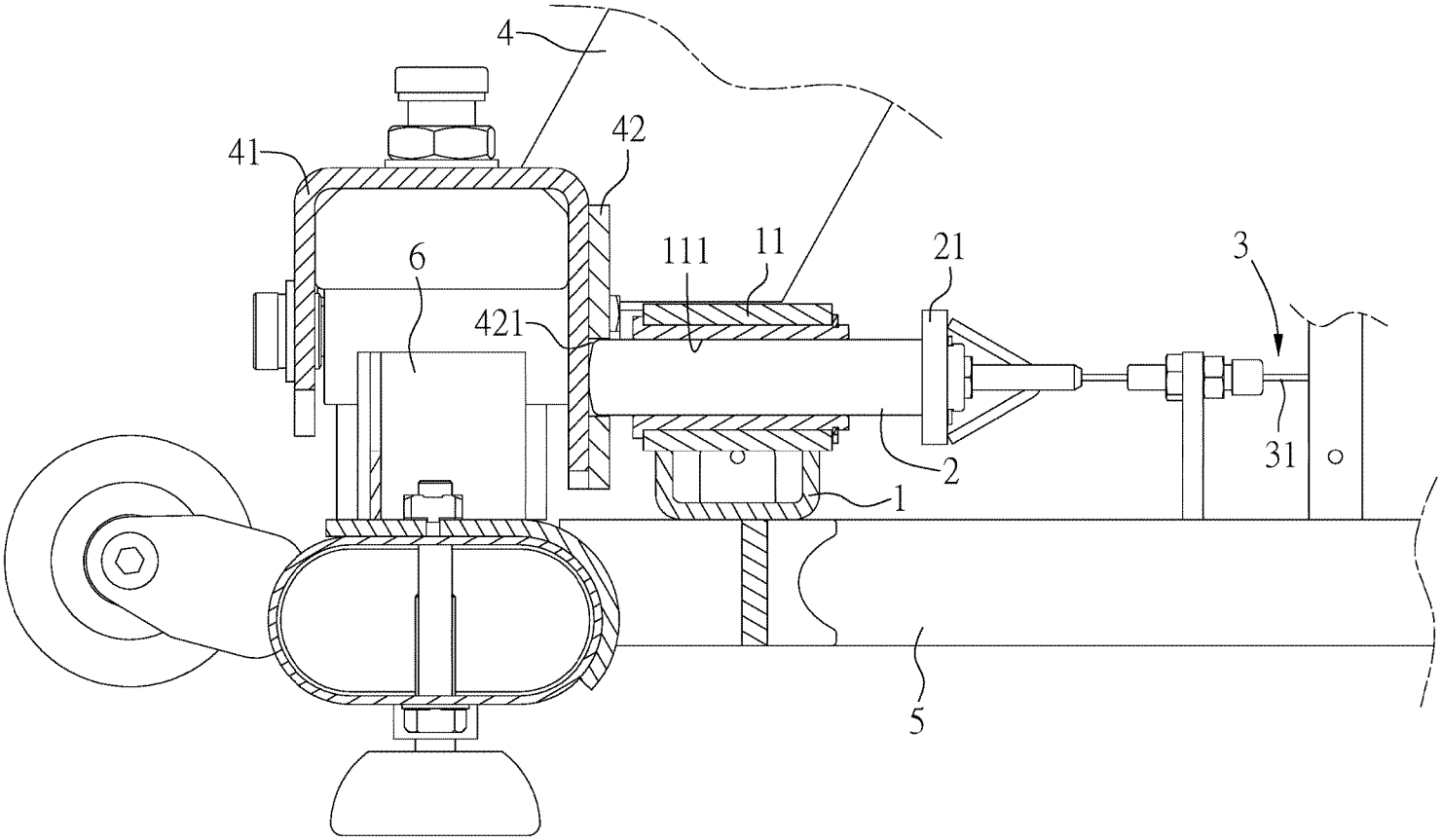
FIG. 5 illustrates a sectional view of another embodiment of the limiting structure of the first embodiment, and the positioning shaft is connected to the positioning portion in the figure.
Figure 6:
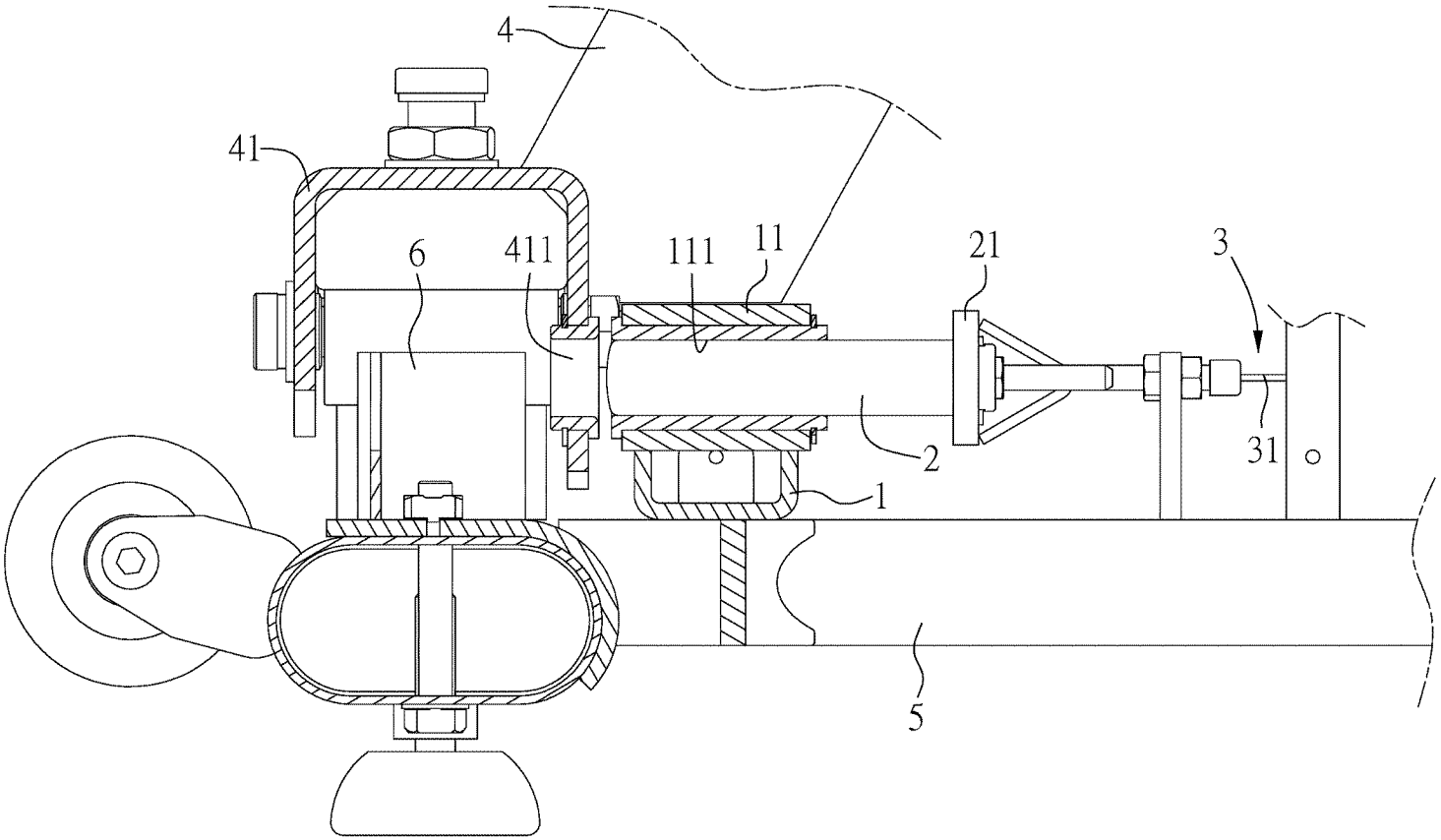
FIG. 6 illustrates another sectional view of the limiting structure of the first embodiment, and the positioning shaft is detached from the positioning portion in the figure.

In this embodiment, the positioning portion 411 is a through hole on the pivot holder 41 for passing through the positioning shaft 2. The positioning portion 411 may be not defined on the pivot holder 41 directly. For instance, as shown in FIG. 5, a plate member 42 has a positioning portion 421 for passing through the positioning shafts 2. Then, the plate member 42 is fixed on a side of the pivot holder 41 the shaft holes 111 are aiming at. Accordingly, the pivot holder 41 can be provided with the positioning portion 421 to be connected to the positioning shafts 2. Furthermore, in this embodiment, the elastic members 6 are polyurethane adhesives.

Figure 7:
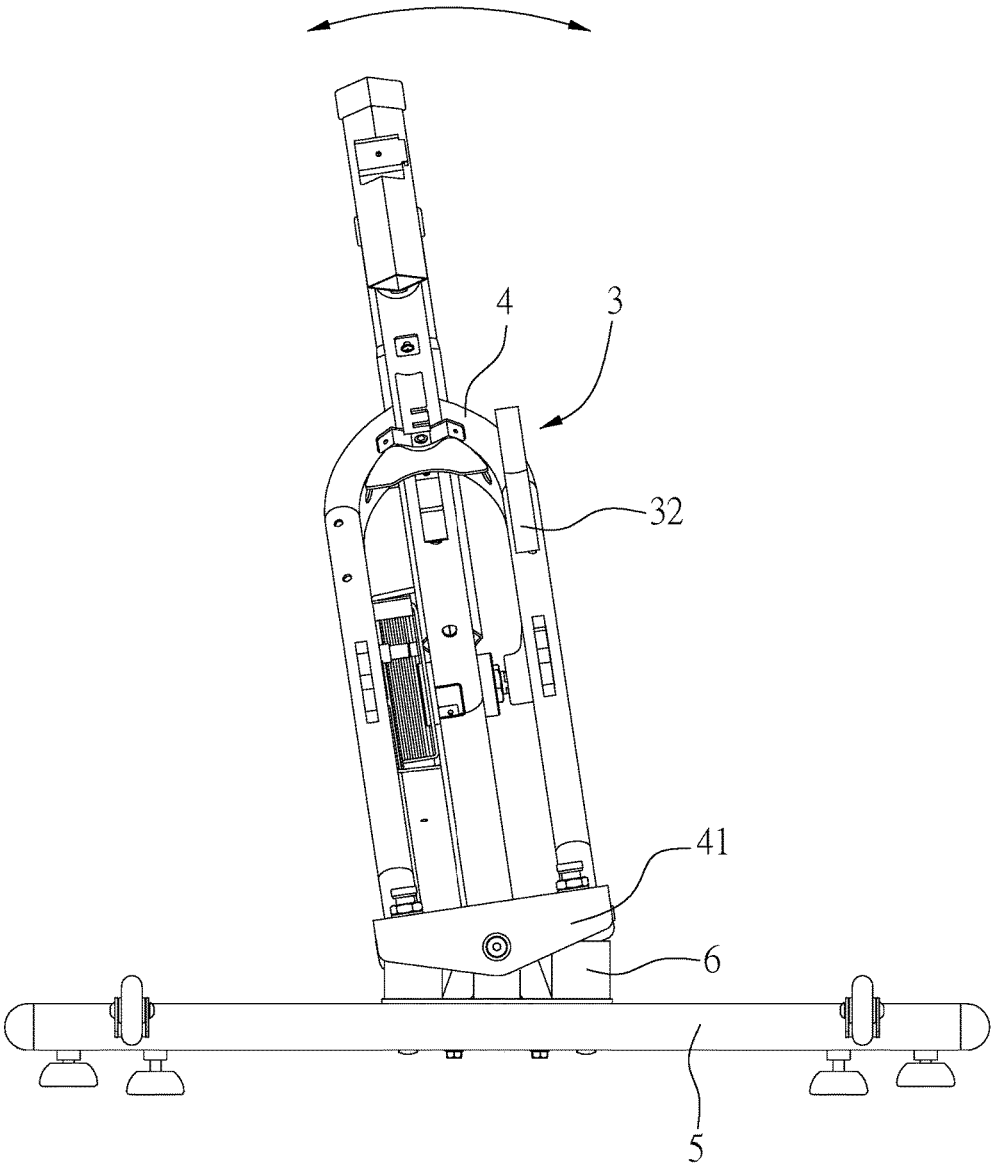
FIG. 7 illustrates an operational view showing that the frame is laterally swung relative to the foundation.

As shown in FIG. 4, when a user rides on the spinning bike and tends to position the frame 4 in a standing state, the controlling member 3 is not operated; namely, the tap switch 32 is not operated and the steel cable 31 is not pulled. Hence, the two positioning shafts 2 are connected to the positioning portion 411, and the pivot holder 41 is limited by the positioning shafts 2 thus the pivot holder 41 is not swung laterally. Therefore, the user can ride on the spinning bike and positions the frame 4 of the bike in the standing state. Conversely, when the user tends to allow the frame 4 to be laterally swingable to mimic road cycling, the user can operate the controlling member 3; namely, the user can operate the tap switch 32 to pull the steel cable 31. Hence, the two positioning shafts 2 are detached from the positioning portion 411, and the pivot holder 41 is not limited by the positioning shafts 2 thus the pivot holder 41 is swingable laterally. Accordingly, as shown in FIG. 7, the user can swing the frame 4 laterally to mimic road cycling.

As above, the advantages of the present invention are described as following. The limiting structure comprising the base 1, the positioning shafts 2, and the controlling member 3 is assembled on the foundation 5, and the controlling member 3 drives the positioning shafts 2 to be slidable in the slidable sleeves 11 so as to be connected to or detached from the positioning portion 411 of the pivot holder 41. Therefore, the pivot holder 41 of the frame 4 can be controlled to be swingable laterally relative to the frame 4 or not to be swingably laterally relative to the frame 4. Hence, the frame 4 can be positioned in a standing state or a laterally swingable state. Accordingly, the user is allowed to ride the bike with both the standing position and the lateral-swingable position conveniently.

Figure 8:
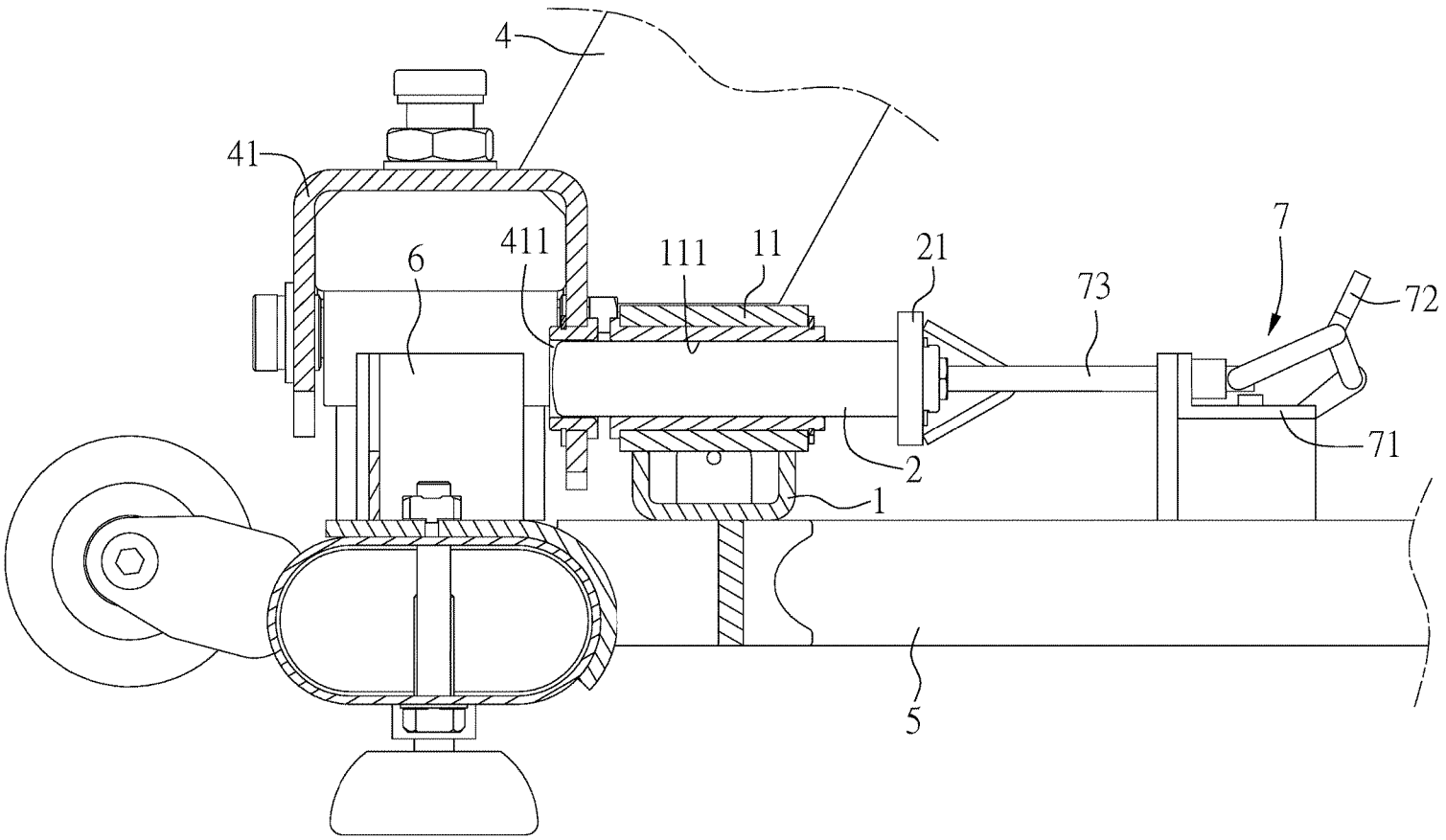
FIG. 8 illustrates a sectional view of a limiting structure according to a second embodiment of the present invention, and the positioning shaft is connected to the positioning portion.
Figure 9:
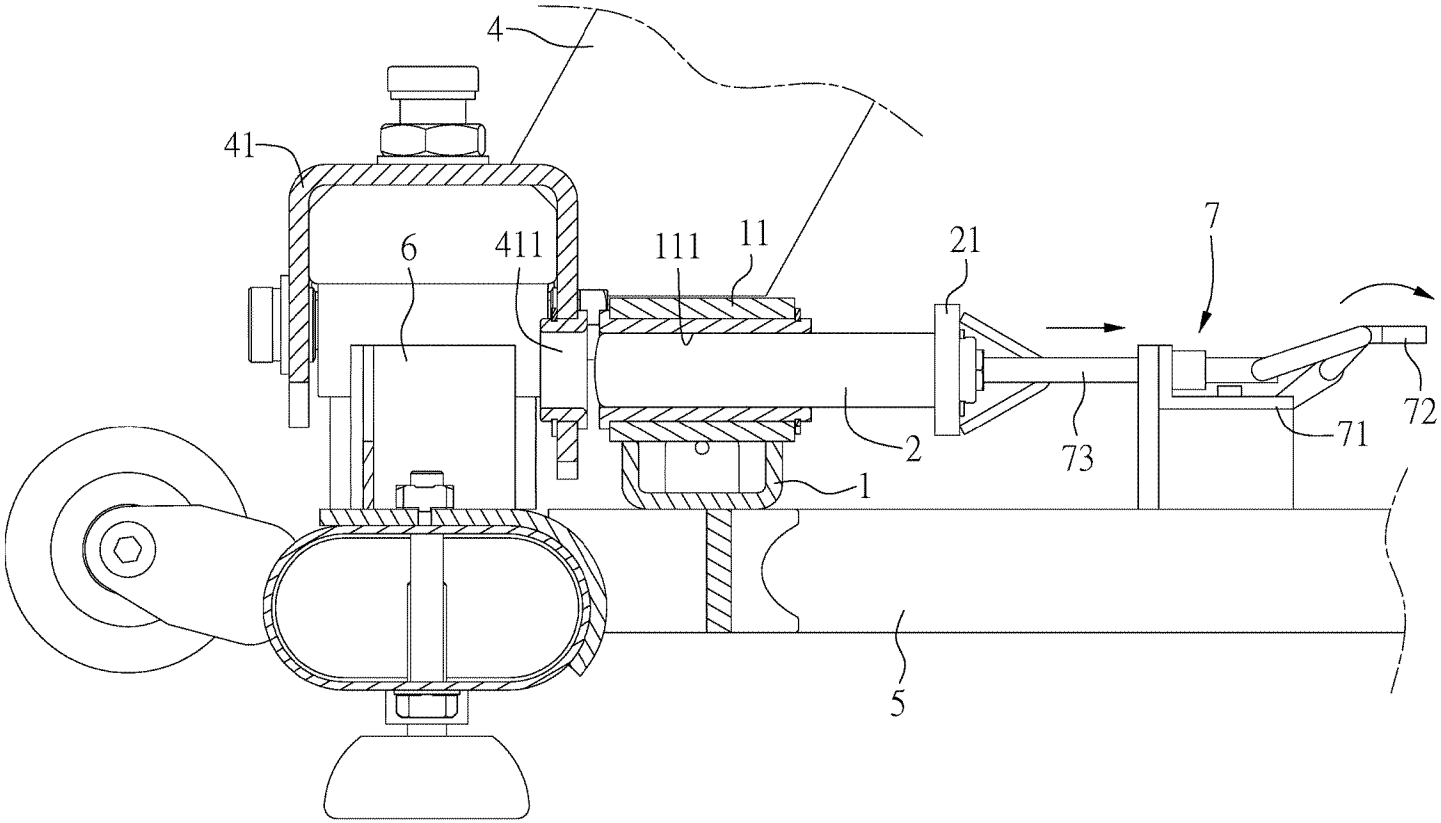
FIG. 9 illustrates another sectional of the limiting structure of the second embodiment, and the positioning shaft is detached from the positioning portion.

It is understood that, the present invention has many examples with some modifications. Please refer to FIGS. 8 and 9, illustrating a limiting structure according to a second embodiment of the present invention. In the second embodiment, the controlling member 7 is a buckle and has a body 71, an operating portion 72, and a connection bar 73. The operating portion 72 is connected to the body 71, the connection bar 73 is connected to the operating portion 72. One end of the connection bar 73 is connected to the connection member 21. The resilient spring 22 drives the two positioning shafts 2 to connect to the positioning portion 411 normally via the connection member 21, or the operating portion 72 is pulled up to control the two positioning shafts 2 to slide at the same time and detach form the positioning portion 411 via the connection bar 73. Therefore, the second embodiment can achieve the same function achieved by the first embodiment.

What is claimed is:

1. A limiting structure for a body-training device, wherein the body-training device is a frame laterally swingably pivoted on a foundation via a pivot holder, and a plurality of elastic members is on the foundation to support the pivot holder to keep the frame standing, when the frame is laterally swung, each of the elastic members is compressed and deformed to maintain the frame to be in a tilt position, wherein the limiting structure comprises:

a base adapted to be fixed on the foundation and near the pivot holder, wherein a slidable sleeve is assembled on the base, the slidable sleeve has a shaft hole facing one side of the base, the pivot holder has a positioning portion aiming at the shaft hole;

a positioning shaft passing through the shaft hole, wherein when the frame is standing, the positioning shaft is slidable to connect to the positioning portion so as to confine the pivot holder not to swing laterally; and a controlling member assembled on the frame and combined with the positioning shaft to control the positioning shaft to be slidable to connect to the positioning portion or to detach from the positioning portion.

2. The limiting structure for a body-training device according to claim 1, wherein two slidable sleeves are assembled on the base, two positioning shafts are slidably assembled in shaft holes of the two slidable sleeves, one ends of the two positioning shafts are connected to the controlling member, so that the control member drives the two positioning shafts to be slid in the shaft holes of the two slidable sleeves at the same time.

3. The limiting structure for a body-training device according to claim 2, wherein the ends of the two positioning shafts are connected to the controlling member via a connection member, the controlling member is a steel cable and a tap switch, one of two ends of the steel cable is connected to the connection member and extending along the frame to a proper position, the other end of the steel cable is connected to the tap switch, a resilient spring is assembled between the connection member and the base, the resilient spring drives the two positioning shafts to connect to the positioning portion normally via the connection member, or the steel cable is pulled to control the two positioning shafts to slide at the same time and detach from the positioning portion via the tap switch.

4. The limiting structure for a body-training device according to claim 2, wherein the ends of the two positioning shafts are connected to the controlling member via a connection member, the controlling member is a buckle, the buckle has a body, an operating portion connected to the body, and a connection bar connected to the operating portion, one end of the connection bar is connected to the connection member, a resilient spring is assembled between the connection member and the base, the resilient spring drives the two positioning shafts to connect to the positioning portion normally via the connection member, or the operating portion is pulled up to control the two positioning shafts to slide at the same time and detach from the positioning portion via the connection bar.

5. The limiting structure for a body-training device according to claim 1, wherein the positioning portion is a through hole on the pivot holder for passing through the positioning shaft.

6. The limiting structure for a body-training device according to claim 1, wherein the elastic members are polyurethane adhesives.

* * * * *